US012492028B1

(12) United States Patent
Wu

(10) Patent No.: US 12,492,028 B1
(45) Date of Patent: Dec. 9, 2025

(54) VACUUM PUMPING DEVICE

(71) Applicant: Hui Wu, Xinyang (CN)

(72) Inventor: Hui Wu, Xinyang (CN)

( * ) Notice: Subject to any disclaimer, the term of this patent is extended or adjusted under 35 U.S.C. 154(b) by 0 days.

(21) Appl. No.: 19/214,226

(22) Filed: May 21, 2025

(51) Int. Cl.
*B65B 31/00* (2006.01)

(52) U.S. Cl.
CPC ..... *B65B 31/00* (2013.01)

(58) Field of Classification Search
None
See application file for complete search history.

(56) References Cited

U.S. PATENT DOCUMENTS

2024/0092513 A1* 3/2024 Yao ..... B65B 31/025

* cited by examiner

*Primary Examiner* — Chinyere J Rushing-Tucker
(74) *Attorney, Agent, or Firm* — JEEN IP LAW, LLC

(57) ABSTRACT

A vacuum pumping device is provided, which includes a negative pressure generating device, and the negative pressure generating device is provided with a first negative pressure suction port and a first connection structure; a Mason bottle adapter, which is provided with a first Mason bottle docking chamber and a second connection structure. The Mason bottle adapter is detachably connected to the first connection structure through the second connection structure, and an airway connection is formed between the first negative pressure suction port and the first Mason bottle docking chamber.

8 Claims, 14 Drawing Sheets

VACUUM PUMPING DEVICE

TECHNICAL FIELD

The present disclosure relates to the field of household electric appliances technologies, and in particular, to a vacuum pumping device.

BACKGROUND

Mason bottle is a sealed container that can be used to store food or perishable items. It can be quickly vacuum sealed using a household Mason bottle vacuum pump, and is therefore widely used in household consumption.

The bottle and lid of the Mason bottle are separate, and the lid can be one piece, two-piece, etc. When sealing the Mason bottle, air inside the bottle can be expelled through the Mason bottle vacuum pump, and the lid can be sealed at atmospheric pressure to facilitate long-term storage of food inside the bottle.

At present, Mason bottle vacuum pumps are generally only suitable for packaging Mason bottles with smaller diameters, so users can choose from fewer Mason bottles.

SUMMARY

The purpose of this application is to overcome the shortcomings of the prior art and provide a vacuum pumping device.

In a first aspect, the present application provides a vacuum pumping device including:

a negative pressure generating device, where the negative pressure generating device is provided with a first negative pressure suction port and a first connecting structure;

a Mason bottle adapter, the Mason bottle adapter is provided with a first Mason bottle docking chamber and a second connection structure, the Mason bottle adapter is detachably connected to the first connection structure through the second connection structure, and an airway connection is formed between the first negative pressure suction port and the first Mason bottle docking chamber.

In some embodiments of the present disclosure, the Mason bottle adapter includes a docking panel, a first side wall provided around an outer circumference of the docking panel on a first side of the docking panel, and a first sealing ring provided on an inner side of the first side wall, where the docking panel, the first side wall, and the first sealing ring are surrounded to form the first Mason bottle docking chamber;

the docking panel is provided with a second negative pressure suction port that is communicated to the first Mason bottle docking chamber;

the first connection structure includes a clamp slot provided on an outer wall of the first negative pressure suction port;

the second connection structure includes a clamp block provided on an inner wall of the second negative pressure suction port;

the Mason bottle adapter is connected to the negative pressure generating device by clamping into the clamp slot through the clamp block.

In some embodiments of the present disclosure, a first sealing surface is provided on a second side of the docking panel, and a third sealing ring is further provided on the outer wall of the first negative pressure suction port;

when the Mason bottle adapter is connected to the negative pressure generating device and the first negative pressure suction port forms the airway connection with the first Mason bottle docking chamber, the third sealing ring abuts against the first sealing surface.

In some embodiments of the present disclosure, the Mason bottle adapter further includes a second side wall provided around an outer circumference of the docking panel on a second side of the docking panel, and a second sealing ring provided in an inner side of the second side wall;

the docking panel, the second side wall, and the second sealing ring are surrounded to form a second Mason bottle docking chamber;

an inner diameter of the second sealing ring is different from that of the first sealing ring;

an outer wall diameter of the first negative pressure suction port is smaller than inner diameters of the first sealing ring and the second sealing ring.

In some embodiments of the present disclosure, a second sealing surface is provided on the first side of the docking panel, and the third sealing ring is further provided on the outer wall of the first negative pressure suction port;

when the Mason bottle adapter is connected to the negative pressure generating device and the first negative pressure suction port forms the airway connection with the second Mason bottle docking chamber, the third sealing ring abuts against the second sealing surface.

In some embodiments of the present disclosure, an inner wall of the first side wall is provided with a first sealing ring recess, the first sealing ring is provided with a first sealing ring installation part, and the first sealing ring installation part is embedded in the first sealing ring recess.

In some embodiments of the present disclosure, an inner wall of the second side wall is provided with a second sealing ring recess, the second sealing ring is provided with a second sealing ring installation part, and the second sealing ring installation part is embedded in the second sealing ring recess.

In some embodiments of the present disclosure, a protrusion height of an end face of the first sealing ring is not less than a depth of the first side wall, and a protrusion height of an end face of the second sealing ring is not less than a depth of the second side wall;

a main housing of the negative pressure generating device is provided with a third sealing surface corresponding to end faces of the first sealing ring and the second sealing ring.

In some embodiments of the present disclosure, an inner wall of the first negative pressure suction port is further provided with a fourth sealing ring adapted to a suction port of a vacuum bag, a suction port of a vacuum box, or a bottle mouth of a wine bottle.

In some embodiments of the present disclosure, a surface of the fourth sealing ring that abuts against the suction port of the vacuum bag, the suction port of the vacuum box, or the bottle mouth of the wine bottle is provided with at least two layers of spaced, ring-shaped flexible bonding parts.

The above technical solution provided by the embodiments of the present application has the following advantages compared to the existing technology.

The vacuum pumping device provided in embodiments of the application consists of a negative pressure generating device and a Mason bottle adapter. The negative pressure generating device and the Mason bottle adapter are detachably connected, and can be adapted to different sizes of Mason bottles by replacing the Mason bottle adapter, thereby improving the applicability of the product.

In some embodiments of the present disclosure, the Mason bottle adapter uses adaptive structures with different sizes on two sides, thereby further reducing the number of adapters.

In some embodiments of the present disclosure, the first negative pressure suction port of the negative pressure generating device is directly provided with the sealing ring for the vacuum bag or red wine bottle, so that the vacuum bag and red wine bottle can be evacuated directly without installing the Mason bottle adapter, thereby further reducing the number of accessories.

BRIEF DESCRIPTION OF DRAWINGS

The accompanying drawings are incorporated into the specification and form a part of the specification, illustrating embodiments in accordance with the present disclosure and used together with the specification to explain the principles of the present disclosure.

In order to provide a clearer explanation of the embodiments of the present disclosure or the technical solutions in the prior art, a brief introduction will be given to the accompanying drawings required for the description of the embodiments or the prior art. It is obvious that for those skilled in the art, other drawings can be obtained based on these drawings without a need for creative work.

One or more embodiments are illustrated by corresponding figures in the accompanying drawings, which do not constitute limitations on the embodiments. Elements with the same reference numbers in the accompanying drawings are represented as similar elements, and unless otherwise specified, the figures in the accompanying drawings do not constitute scale limitations.

Figure 1A:
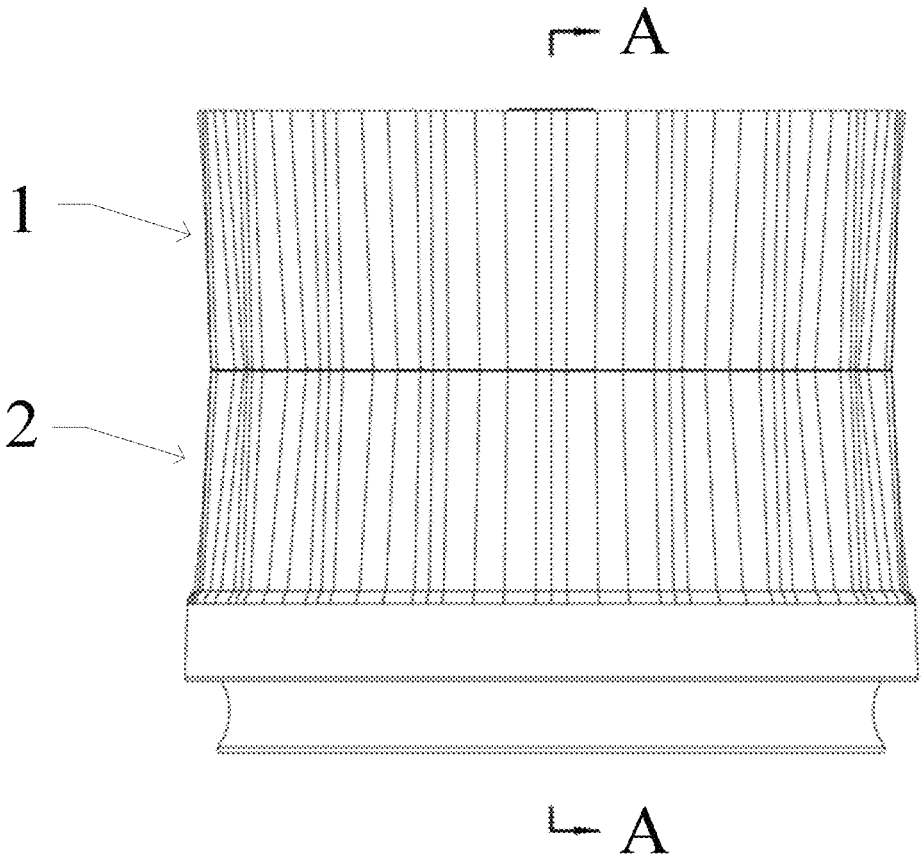

FIG. 1A is a first schematic structural diagram of a vacuum pumping device of the present disclosure.

Figure 1B:
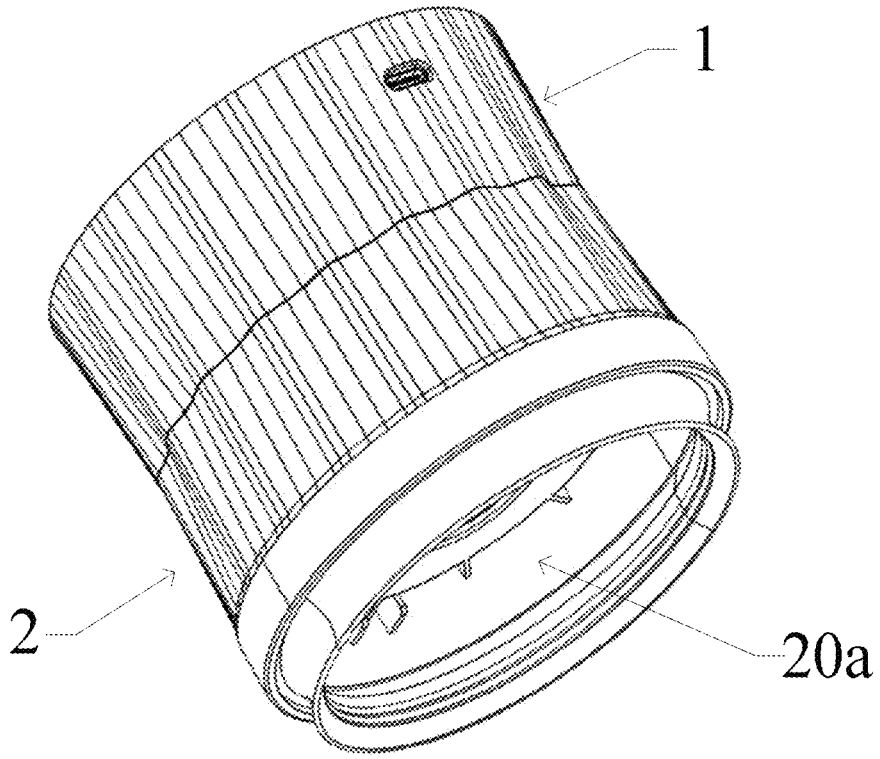

FIG. 1B is a second schematic structural diagram of the vacuum pumping device of the present disclosure (from another perspective).

Figure 2:
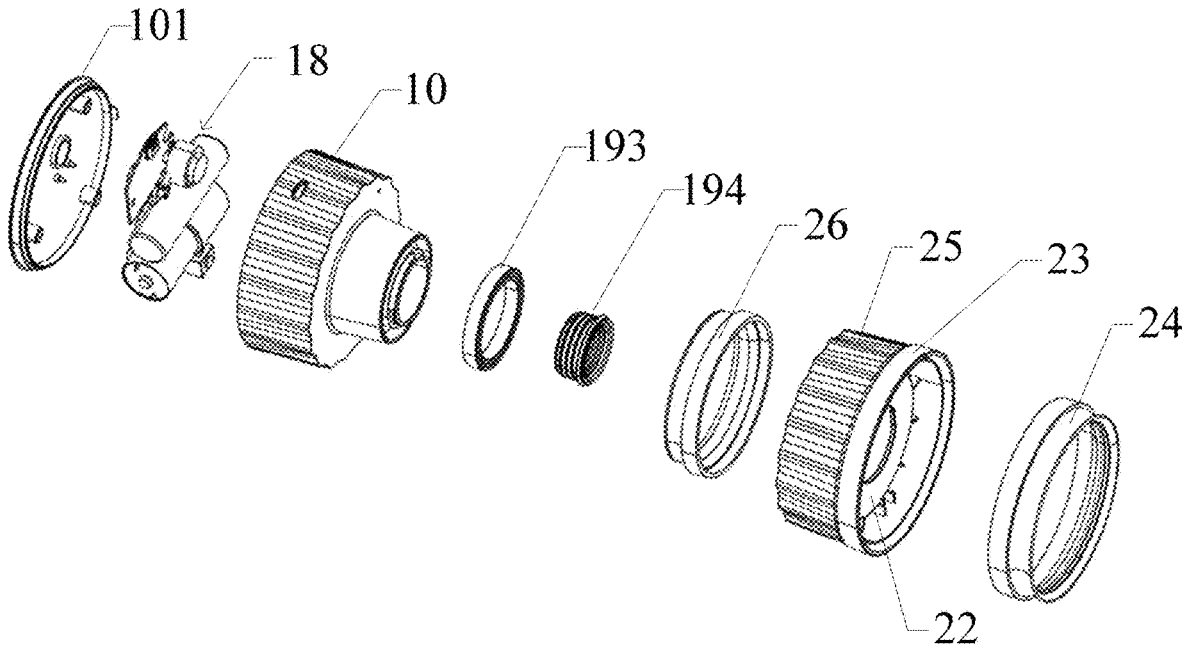

FIG. 2 is an exploded schematic structural diagram of the vacuum pumping device of the present disclosure.

Figure 3:
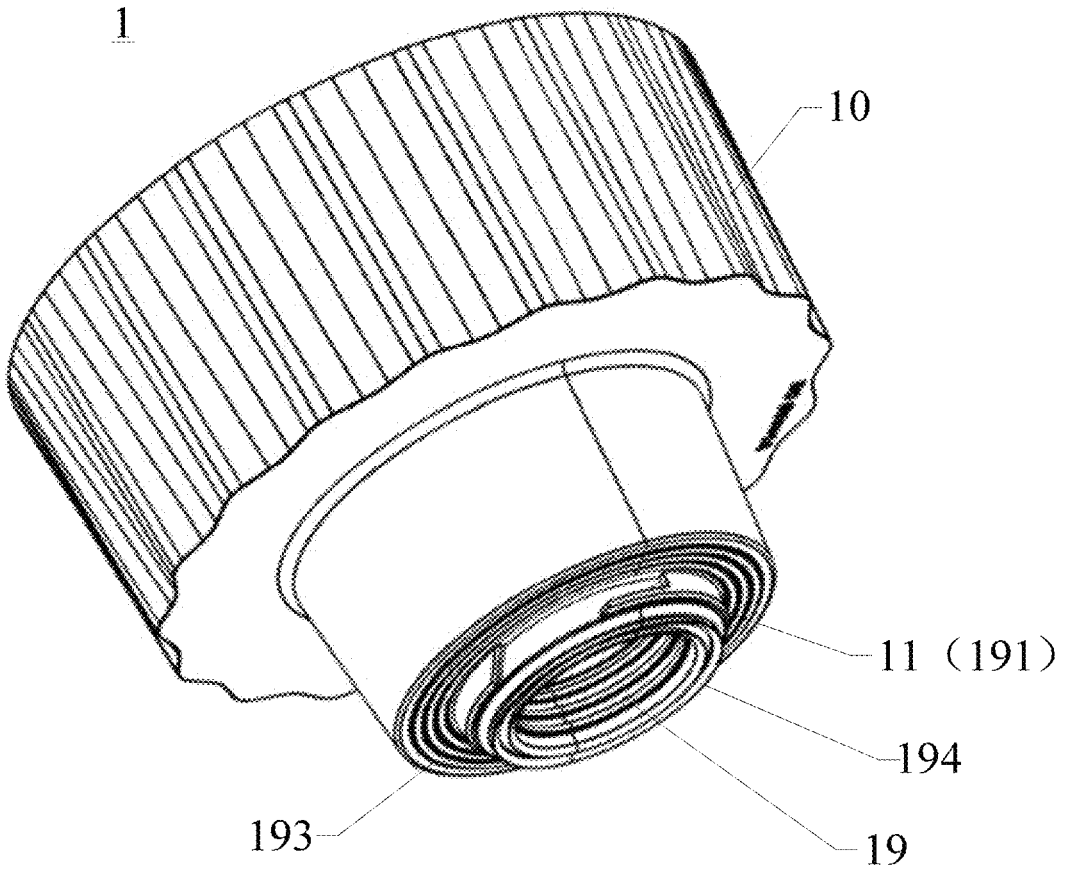

FIG. 3 is a schematic structural diagram of a negative pressure generating device of the present disclosure.

Figure 4:
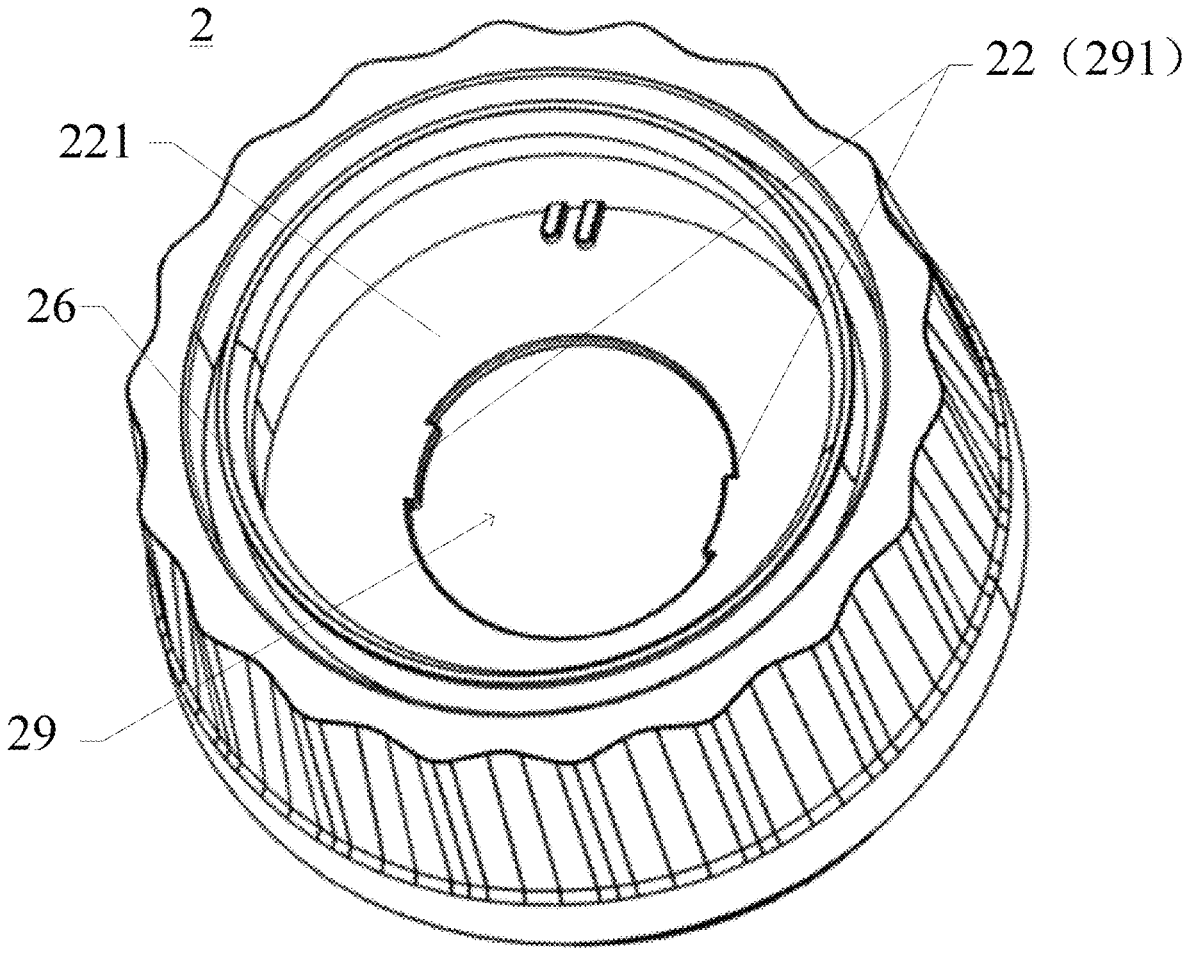

FIG. 4 is a schematic structural diagram of a Mason bottle adapter of the present disclosure.

Figure 5:
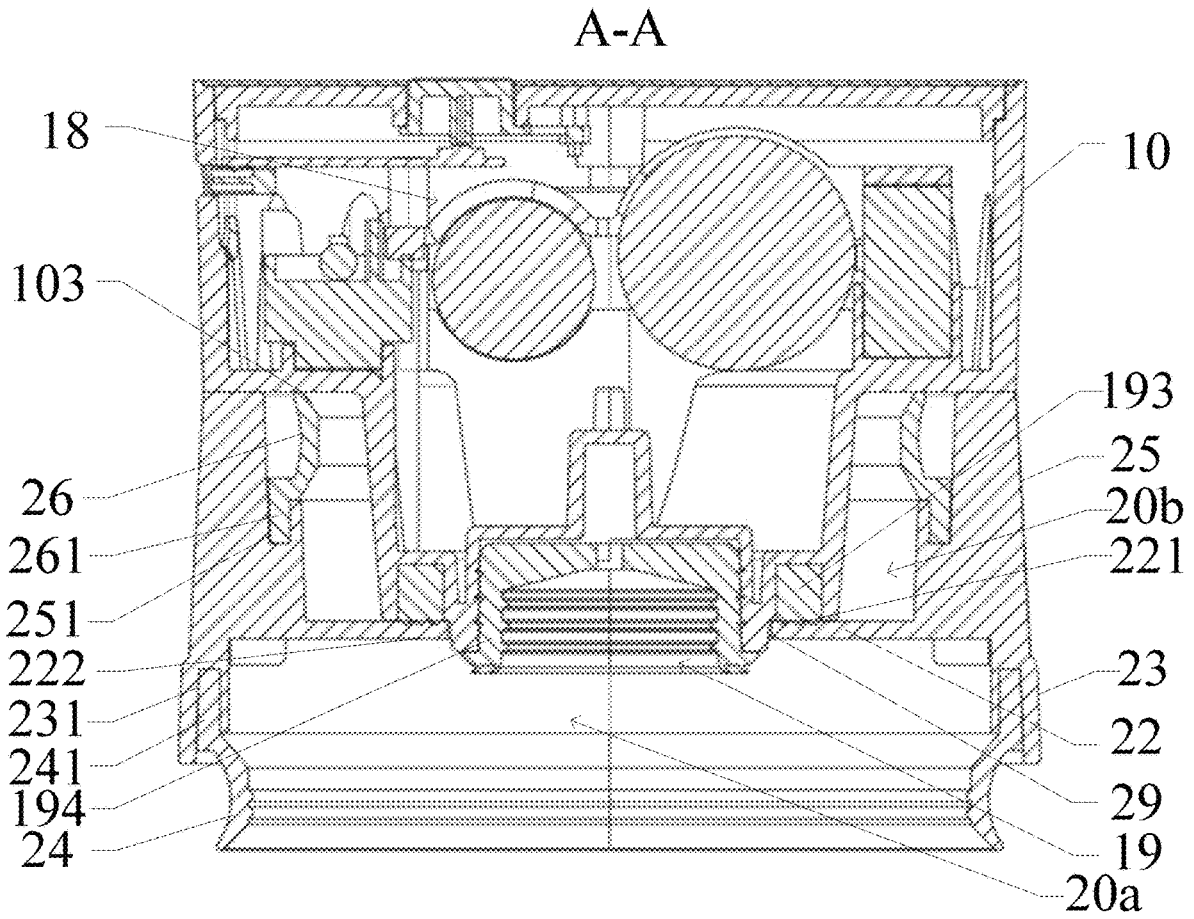

FIG. 5 is a schematic diagram of a A-A cross-sectional structure of FIG. 1.

Figure 6:
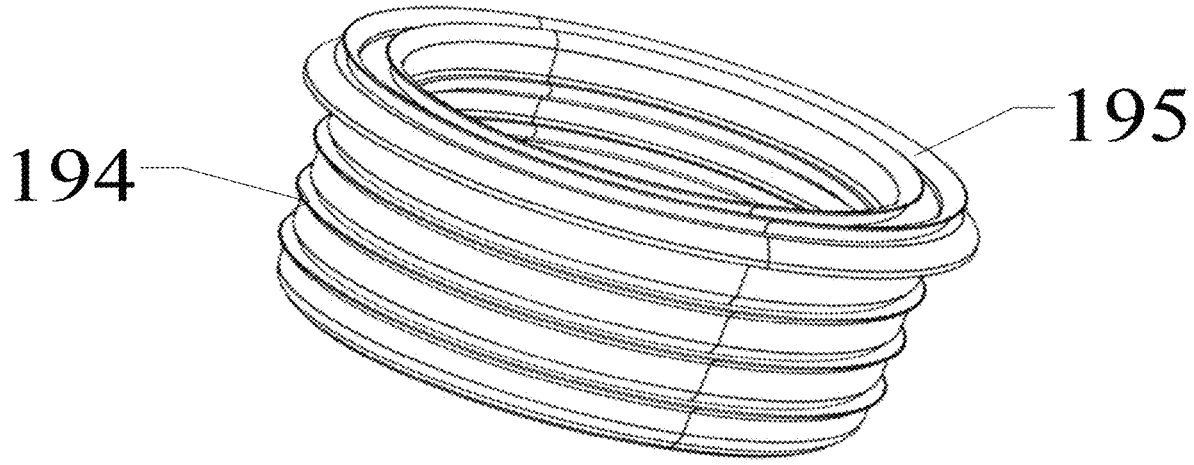

FIG. 6 is a schematic diagram of the structure of a fourth sealing ring of the present disclosure.

Figure 7A:
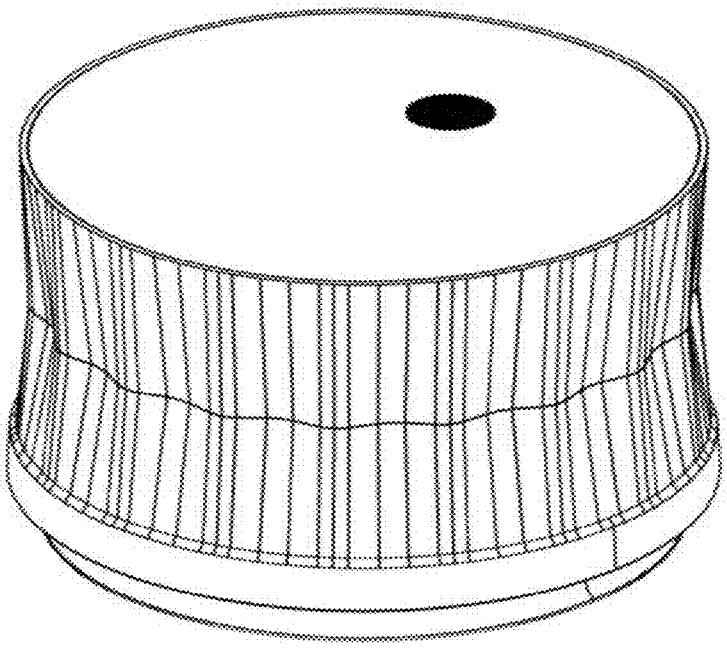

FIG. 7A is a schematic diagram of a docking state between the negative pressure generating device of the present disclosure and the Mason bottle adapter (for large-diameter Mason bottle).

Figure 7B:
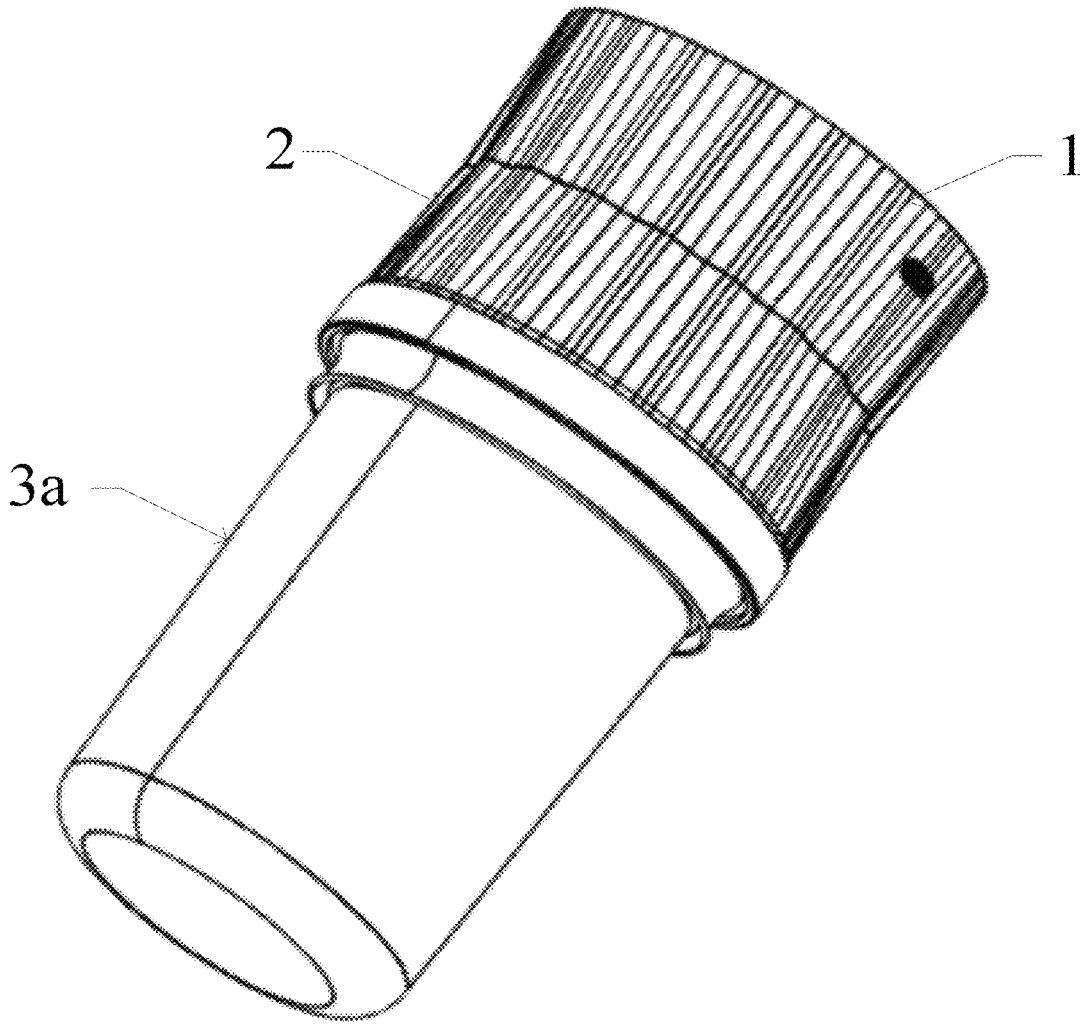

FIG. 7B is a schematic diagram of the vacuum pumping device of the present disclosure for evacuating a large-diameter Mason bottle.

Figure 8:
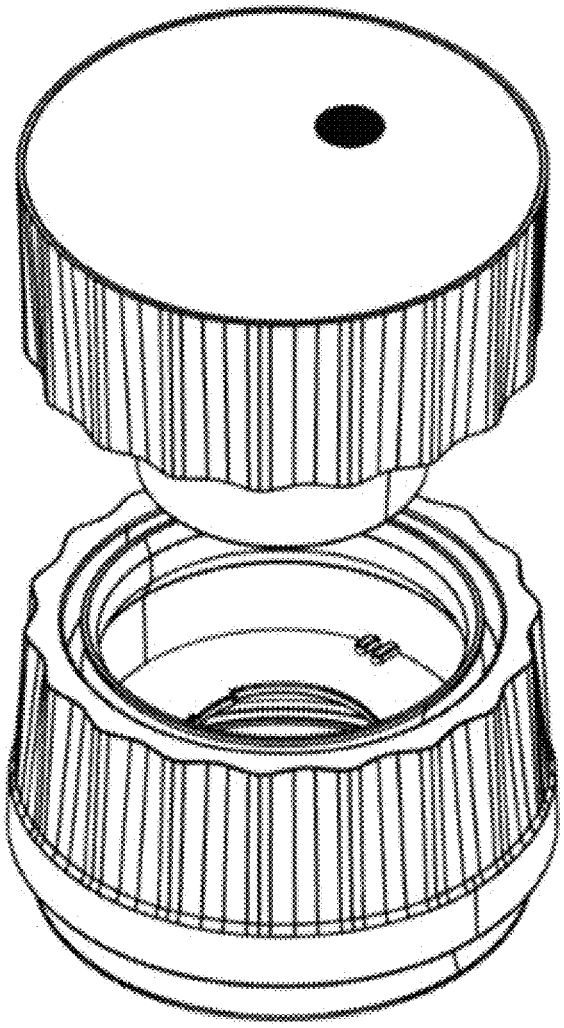

FIG. 8 is a schematic diagram of a disassembly of the Mason bottle adapter of the present disclosure (for a large-diameter state).

Figure 9A:
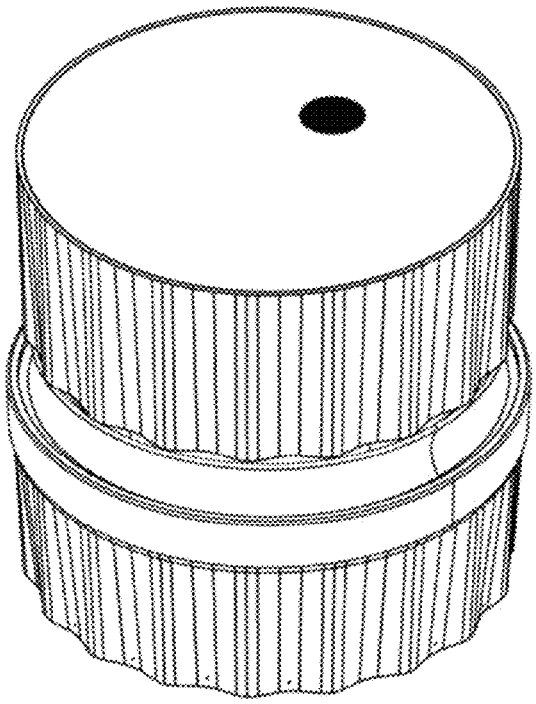

FIG. 9A is a schematic diagram of a docking state between the negative pressure generating device of the present disclosure and the Mason bottle adapter (for a small-diameter Mason bottle).

Figure 9B:
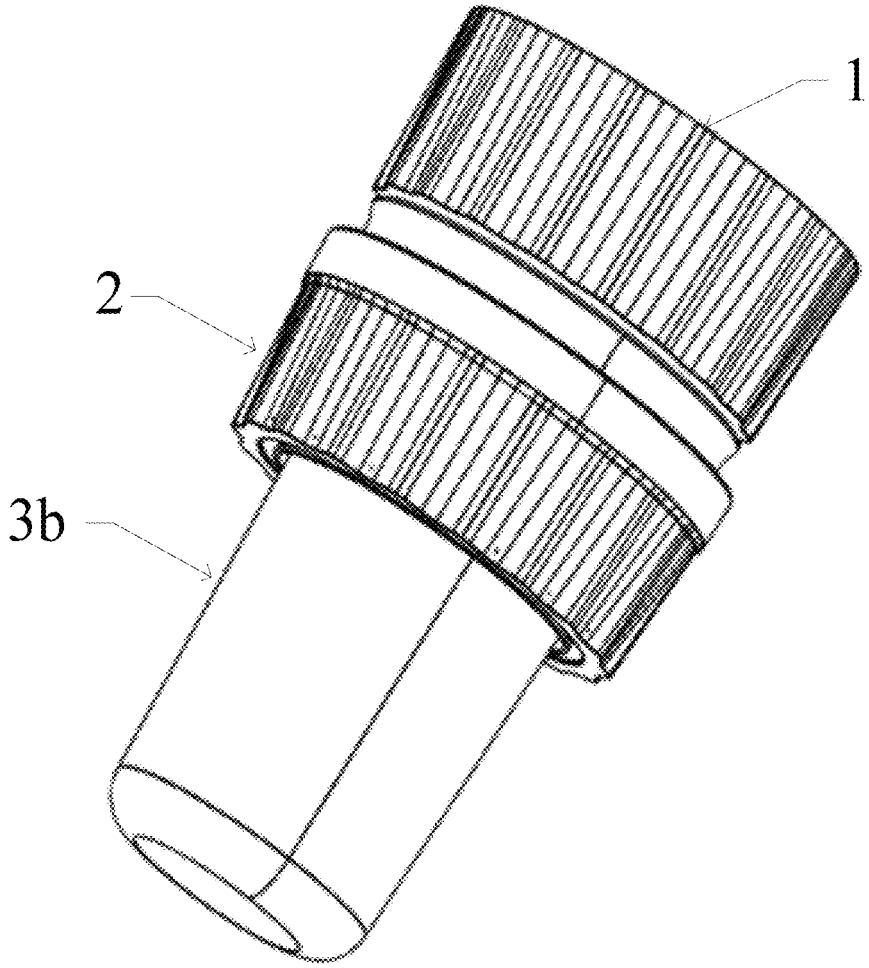

FIG. 9B is a schematic diagram of the vacuum pumping device of the present disclosure for evacuating a small-diameter Mason bottle.

Figure 10:
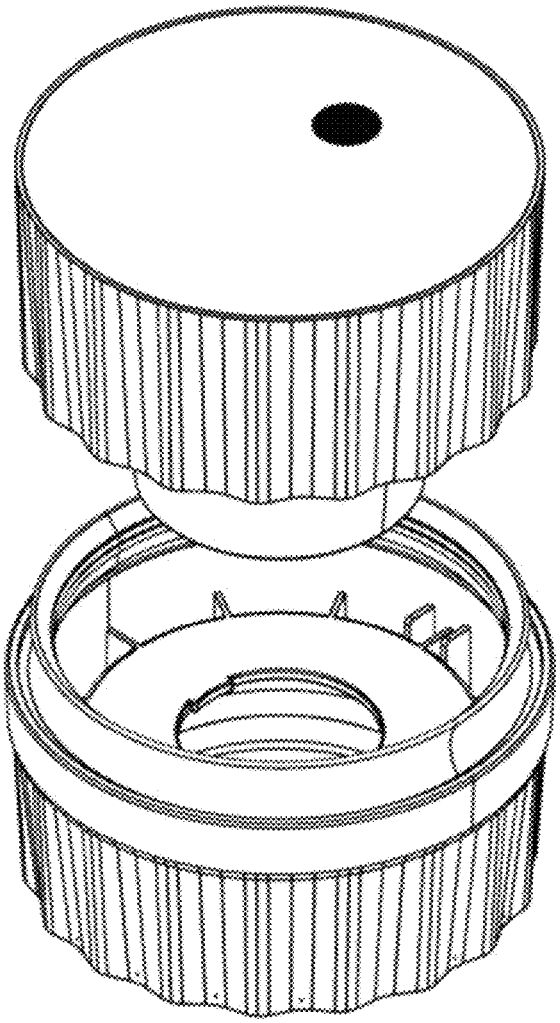

FIG. 10 is a schematic diagram of the disassembly of the Mason bottle adapter of the present disclosure (for small-diameter state).

Figure 11:
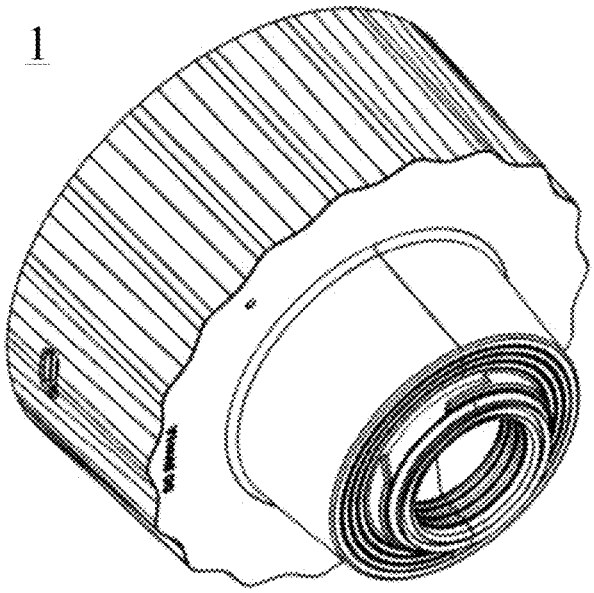

FIG. 11 is a schematic diagram of the negative pressure generating device of the present disclosure when used alone.

DESCRIPTION OF EMBODIMENTS

In order to clarify the purpose, technical solution, and advantages of the embodiments of the present application, the following will provide a clear and complete description of the technical solution in the embodiments of the present application in combination with the accompanying drawings. Obviously, the described embodiments are a part of the embodiments of the present application, not all of them. Based on the embodiments in this application, all other embodiments obtained by those skilled in the art without creative work are within the protection scope of this application.

The following disclosure provides many different embodiments or examples for implementing different structures of the present disclosure. In order to simplify the disclosure of the present disclosure, specific examples of components and settings will be described in the following description. Of course, they are only examples and are not intended to limit the present disclosure. Besides that, the present disclosure can repeat reference numbers and/or letters in different examples. This repetition is for a purpose of simplification and clarity, and does not in itself indicate the relationship between the various embodiments and/or settings discussed.

For ease of description, spatial relative relationship terms can be used in the description to describe a relative position or motion of an element or feature shown in the figure relative to another element or feature. These relative relationship terms include "internal", "external", "inner", "outer", "lower", "lower", "upper", "upper", "front", "rear", etc. This spatial relative relationship term means to include different orientations of the device in use or operation, in addition to the orientations depicted in the figure. For example, if the device in the figure undergoes a position flip, attitude change, or motion state change, these directional indications will also change accordingly. For example, elements described as "below other elements or features" or "below other elements or features" will subsequently be oriented as "above other elements or features" or "above other elements or features".

Therefore, the example term "below" can include orientations above and below. The device can be oriented separately (rotated 90 degrees or in other directions) and the spatial relative relationship descriptors used in the specification are explained accordingly.

As shown in FIGS. 1A, 1B, and 2, a vacuum pumping device is provided in an embodiment, which includes a negative pressure generating device 1 and a Mason bottle adapter 2. The Mason bottle adapter 2 can be detachably connected to the negative pressure generating device 1. For Mason bottles of different diameter types, the diameter adaptation type can be changed by changing an installation direction of the Mason bottle adapter 2. At the same time, other sizes of Mason bottle adapters 2 can also be directly replaced to adapt to larger sizes of Mason bottles.

In this embodiment, the negative pressure generating device 1 mainly includes a main housing 10 and a negative pressure component 18 provided in it. The negative pressure component 18 generates power to form a negative pressure. The main housing 10 of the negative pressure generating device 1 is provided with a first negative pressure suction port 19 to form an airway connection with the Mason bottle adapter 2, and a first connection structure 11 is further provided to form a detachable fixed connection with the Mason bottle adapter 2. The airway connection described in this embodiment refers to a passage formed by the connection through which air can flow and has a certain degree of sealing performance.

In this embodiment, the Mason bottle adapter 2 is provided with a first Mason bottle docking chamber 20*a* and a second connection structure 21. The Mason bottle adapter 2 is detachably connected to the first connection structure 11 through the second connection structure 21, and the airway connection is formed between the first negative pressure suction port 19 and the first Mason bottle docking chamber 20*a*.

As shown in FIGS. 2-5, the Mason bottle adapter 2 includes a docking panel 22, a first side wall 23 provided around an outer circumference of the docking panel 22 on a first side of the docking panel 22, and a first sealing ring 24 provided on an inner side of the first side wall 23. The docking panel 22, the first side wall 23, and the first sealing ring 24 are surrounded to form the first Mason bottle docking chamber 20*a*.

In an implementation mode, the docking panel 22 is provided with a second negative pressure suction port 29 that is communicated to the first Mason bottle docking chamber 20*a*. The first connection structure 11 includes a clamp slot 191 provided on an outer wall of the first negative pressure suction port 19, and the second connection structure 21 includes a clamp block 291 provided on an inner wall of the second negative pressure suction port 29. The Mason bottle adapter 2 is connected to the negative pressure generating device 1 by clamping into the clamp slot 191 through the clamp block 291. In an implementation mode, the clamp slot 191 is an L-shaped groove formed by starting from a docking direction of the Mason bottle adapter 2 and turning towards an outer wall of the first negative pressure suction port 19. When the Mason bottle adapter 2 is docked with the negative pressure generating device 1, the Mason bottle adapter 2 is first inserted in the docking direction, and then it is rotated along a circumference to form a limit, which can achieve the docking of the negative pressure generating device 1 and the Mason bottle adapter 2.

In an implementation mode, the first connection structure 11 can also be a clamp block, and the second connection structure 21 can also be a clamp slot.

In an implementation mode, the first connection structure 11 can also be threaded, and the second connection structure 21 can also be threaded.

In an implementation mode, the first connection structure 11 may also be an elastic buckle, and the second connection structure 22 may be a bayonet.

In an implementation mode, a second side of the docking panel 22 is provided with a first sealing surface 221, and a third sealing ring 193 is further provided on an outer wall of the first negative pressure suction port 19. When the Mason bottle adapter 2 is connected to the negative pressure generating device 1 and the first negative pressure suction port 19 forms the airway connection with the first Mason bottle docking chamber 20*a*, the third sealing ring 193 abuts against the first sealing surface 221. The third sealing ring 193 is configured to achieve a sealing between the first negative pressure suction port 19 and the first Mason bottle docking chamber 20A, thereby ensuring the sealing of the airway.

In an implementation mode, the Mason bottle adapter 2 further includes a second side wall 25 provided around an outer circumference of the docking panel 22 on a second side of the docking panel 22, and a second sealing ring 26 provided on an inner side of the second side wall 25. The docking panel 22, the second side wall 25, and the second sealing ring 26 are surrounded to form a second Mason bottle docking chamber 20*b*, and an inner diameter of the second sealing ring 26 is different from that of the first sealing ring 24. An outer wall diameter of the first negative pressure suction port 19 is smaller than inner diameters of the first sealing ring 24 and the second sealing ring 26. By providing the second side wall 25 and the second sealing ring 26, it is possible to achieve the function of an adapter that can adapt to two sizes of Mason bottles, thereby improving the applicability of the adapter and reducing the number of accessories.

In this embodiment, the first side of the docking panel 22 is provided with a second sealing surface 222, and an outer wall of the first negative pressure suction port 19 is further provided with the third sealing ring 193. When the Mason bottle adapter 2 is connected to the negative pressure generating device 1 and the first negative pressure suction port 19 is connected to the second Mason bottle docking chamber 20*b* to form the airway connection, the third sealing ring 193 abuts against the second sealing surface 222. The sealing between the first negative pressure suction port 19 and the second Mason bottle docking chamber 20*b* is achieved through the third sealing ring 193, thereby ensuring the sealing of the airway.

In an implementation mode, an inner wall of the first side wall 23 is provided with a first sealing ring recess 231, and the first sealing ring 24 is provided with a first sealing ring installation part 241, the first sealing ring installation part 241 is embedded in the first sealing ring recess 231.

In an implement mode, an inner wall of the second side wall 25 is provided with a second sealing ring recess 251, and the second sealing ring 26 is provided with a second sealing ring installation part 261, the second sealing ring installation part 261 is embedded in the second sealing ring recess 251.

In this embodiment, a protrusion height of an end face of the first sealing ring 24 is not less than a depth of the first side wall 23, and a protrusion height of an end face of the second sealing ring 26 is not less than a depth of the second side wall 25. The main housing 10 of the negative pressure generating device 1 is provided with a third sealing surface 103 corresponding to end faces of the first sealing ring 24 and the second sealing ring 26. In this way, a sealing can be formed between end faces of the first sealing ring 24 and the second sealing ring 26 with the main housing 10, thereby forming a secondary sealing between the first Mason bottle docking chamber 20*a*, the second Mason bottle docking chamber 20*b* and the first negative pressure suction port 19, further ensuring the reliability of the sealing.

In this embodiment, as shown in FIGS. 2, 4, and 5, an inner wall of the first negative pressure suction port 19 is further provided with a fourth sealing ring 194 that is compatible with a suction port of a vacuum bag or a bottle mouth of a red wine bottle. When vacuuming the vacuum bag or wine bottle, there is no need to connect the Mason bottle adapter 2. The first negative pressure suction port 19 of the negative pressure generating device 1 is simply aligned with the suction port of the vacuum bag or the bottle mouth of the wine bottle. This eliminates the need for a dedicated adapter for vacuum bags or wine bottles, as well as corresponding adapter, reducing the number and cost of product accessories.

In an implementation mode, a surface of the fourth sealing ring 194 that abuts against the suction port of the vacuum bag or the bottle mouth of the red wine bottle is provided with at least two layers of spaced, ring-shaped flexible bonding parts 195. The flexible bonding parts 195 can be well attached to a suction port surface of the vacuum bag and the bottle mouth of the red wine bottle, and the use of a two-layer structure can achieve better surface adhesion, thereby achieving better sealing performance and ensuring the vacuum pumping effect.

Based on the above, as shown in FIG. 7A, a docking state of the Mason bottle adapter during vacuum pumping for large-diameter Mason bottles is shown. Combined with FIG. 5, at this time, the first Mason bottle docking chamber 20*a* of the Mason bottle adapter 2 is facing away from the negative pressure generating device 1, and the first Mason bottle docking chamber 20*a* can be docked with large-diameter Mason bottles. FIG. 7B shows a schematic diagram of the negative pressure generating device 1 for vacuuming the large-diameter Mason bottle 3*a* after docking with the Mason bottle adapter 2. At this time, the large-diameter Mason bottle 3*a* is docked with the first Mason bottle docking chamber 20*a*. In this embodiment, the Mason bottle adapter 2 and the negative pressure generating device 1 can be quickly disassembled. FIG. 8 shows a disassembled state of the Mason bottle adapter. FIG. 9A shows a docking state of the Mason bottle adapter when vacuuming a small-diameter Mason bottle. Combined with FIG. 5, at this time, the second Mason bottle docking chamber 20*b* of the Mason bottle adapter 2 is facing away from the negative pressure generating device 1, and can be docked with the small-diameter Mason bottle. FIG. 9B shows a schematic diagram of the negative pressure generating device 1 for vacuuming the large-diameter Mason bottle 3*a* after docking with the Mason bottle adapter 2. At this time, the large-diameter Mason bottle 3*a* is docked with the first Mason bottle docking chamber 20*a*. In this embodiment, the Mason bottle adapter 2 and the negative pressure generating device 1 can be quickly disassembled. FIG. 10 shows a disassembled state of the Mason bottle adapter.

In this embodiment, the negative pressure generating device 1 can be used alone to achieve vacuum pumping operations on some products. As shown in FIG. 11, the negative pressure generating device 1 can be used alone after disassembling the Mason bottle adapter. Due to a fact that the negative pressure generating device 1 is provided with the fourth sealing ring 194, a shape of the fourth sealing ring 194 is adapted to a shape of the suction port of the food preservation bag (vacuum bag), a suction port of the preservation box, the bottle mouth of the red wine bottle, etc., thus enabling vacuum pumping operations on these products.

It should be understood that terminology term used in the specification is only for a purpose of describing specific example embodiments and is not intended to be limiting. Unless otherwise explicitly stated in the specification, singular forms such as "a", "an", and "the" used in the specification may also indicate the inclusion of plural forms. The terms "including", "containing", "including", and "having" are inclusive and therefore indicate the presence of the stated features, steps, operations, elements, and/or components, but do not exclude the presence or addition of one or more other features, steps, operations, elements, components, and/or combinations thereof. The method steps, processes, and operations described in the specification are not interpreted as requiring them to be executed in the specific order described or illustrated, unless the execution order is explicitly stated. It should also be understood that additional or alternative steps can be used.

Although the terms "first", "second", "third", etc. may be used in the specification to describe multiple elements, components, regions, layers, and/or segments, these elements, components, regions, layers, and/or segments should not be limited by these terms. These terms can only be used to distinguish one component, part, area, layer, or section from another. Unless explicitly stated in the specification, terms such as "first", "second", and other numerical terms used in the specification do not imply order or sequence. Therefore, the first element, component, region, layer, or section discussed below may be referred to as the second element, component, region, layer, or section without departing from the teachings of the example embodiments.

The above is only a specific implementation of the present disclosure, which enables those skilled in the art to understand or implement the present disclosure. Various modifications to these embodiments will be apparent to those skilled in the art, and general principles defined in this specification can be implemented in other embodiments without departing from the spirit or scope of the present disclosure. Therefore, the present disclosure will not be limited to the embodiments shown in this specification, but will conform to a widest scope consistent with the principles and novel features applied in this specification.

What is claimed is:

1. A vacuum pumping device, comprising:

a negative pressure generating device, wherein the negative pressure generating device is provided with a first negative pressure suction port and a first connecting structure;

a Mason bottle adapter, the Mason bottle adapter is provided with a first Mason bottle docking chamber and a second connection structure, the Mason bottle adapter is detachably connected to the first connection structure through the second connection structure, and an airway connection is formed between the first negative pressure suction port and the first Mason bottle docking chamber;

wherein the Mason bottle adapter comprises a docking panel, a first side wall provided around an outer circumference of the docking panel on a first side of the docking panel, and a first sealing ring provided on an inner side of the first side wall, wherein the docking panel, the first side wall, and the first sealing ring are surrounded to form the first Mason bottle docking chamber;

the docking panel is provided with a second negative pressure suction port that is communicated to the first Mason bottle docking chamber;

the first connection structure comprises a clamp slot provided on an outer wall of the first negative pressure suction port;

the second connection structure comprises a clamp block provided on an inner wall of the second negative pressure suction port;

the Mason bottle adapter is connected to the negative pressure generating device by clamping into the clamp slot through the clamp block;

wherein the Mason bottle adapter further comprises a second side wall provided around an outer circumference of the docking panel on a second side of the docking panel, and a second sealing ring provided in an inner side of the second side wall;

the docking panel, the second side wall, and the second sealing ring are surrounded to form a second Mason bottle docking chamber;

an inner diameter of the second sealing ring is different from that of the first sealing ring;

an outer wall diameter of the first negative pressure suction port is smaller than inner diameters of the first sealing ring and the second sealing ring.

2. The vacuum pumping device according to claim 1, wherein a first sealing surface is provided on a second side of the docking panel, and a third sealing ring is further provided on the outer wall of the first negative pressure suction port;

when the Mason bottle adapter is connected to the negative pressure generating device and the first negative pressure suction port forms the airway connection with the first Mason bottle docking chamber, the third sealing ring abuts against the first sealing surface.

3. The vacuum pumping device according to claim 2, wherein a second sealing surface is provided on the first side of the docking panel, and the third sealing ring is further provided on the outer wall of the first negative pressure suction port;

when the Mason bottle adapter is connected to the negative pressure generating device and the first negative pressure suction port forms the airway connection with the second Mason bottle docking chamber, the third sealing ring abuts against the second sealing surface.

4. The vacuum pumping device according to claim 2, wherein an inner wall of the first side wall is provided with a first sealing ring recess, the first sealing ring is provided with a first sealing ring installation part, and the first sealing ring installation part is embedded in the first sealing ring recess.

5. The vacuum pumping device according to claim 2, wherein an inner wall of the second side wall is provided with a second sealing ring recess, the second sealing ring is provided with a second sealing ring installation part, and the second sealing ring installation part is embedded in the second sealing ring recess.

6. The vacuum pumping device according to claim 5, wherein a protrusion height of an end face of the first sealing ring is not less than a depth of the first side wall, and a protrusion height of an end face of the second sealing ring is not less than a depth of the second side wall;

a main housing of the negative pressure generating device is provided with a third sealing surface corresponding to end faces of the first sealing ring and the second sealing ring.

7. The vacuum pumping device according to claim 6, wherein an inner wall of the first negative pressure suction port is further provided with a fourth sealing ring adapted to a suction port of a vacuum bag, a suction port of a vacuum box, or a bottle mouth of a wine bottle.

8. The vacuum pumping device according to claim 7, wherein a surface of the fourth sealing ring that abuts against the suction port of the vacuum bag, the suction port of the vacuum box, or the bottle mouth of the wine bottle is provided with at least two layers of spaced, ring-shaped flexible bonding parts.

* * * * *